United States Patent [19]

Asada et al.

[11] Patent Number: 4,986,933

[45] Date of Patent: Jan. 22, 1991

[54] RESISTOR COMPOSITION

[75] Inventors: Eiichi Asada, Tokyo; Mikio Yamazoe, Hamuramachi; Shigeru Matsumura, Oume, all of Japan

[73] Assignee: Shoei Chemical Inc., Tokyo, Japan

[21] Appl. No.: 496,968

[22] Filed: Mar. 21, 1990

[30] Foreign Application Priority Data

Mar. 31, 1989 [JP] Japan ..... 1-82569

[51] Int. Cl.[5] ..... H01C 7/00; H01C 8/00

[52] U.S. Cl. ..... 252/518; 252/519; 252/521

[58] Field of Search ..... 252/518, 521, 519

[56] References Cited

U.S. PATENT DOCUMENTS 4,065,743 12/1977 Wahlers et al. ..... 252/518
4,707,346 11/1987 Hormadaly ..... 252/518

FOREIGN PATENT DOCUMENTS 64-8441 2/1989 Japan .
1-248501 10/1989 Japan .
1-248502 10/1989 Japan .
1209947 10/1970 United Kingdom .

*Primary Examiner*—Josephine Barr
*Assistant Examiner*—Bradley A. Swope
*Attorney, Agent, or Firm*—Flynn, Thiel, Boutell & Tanis

[57] ABSTRACT

A resistor composition comprising at least one electrically conductive powder selected from the group consisting of (a) tin oxide power and (b) powder resulting from heat treatment of tin oxide and tantalum oxide, a glass frit and double oxide of tantalum dispersed in an organic vehicle. In the resistor composition, the mixing amount of the double oxide of tantalum is preferably 30 parts by weight or less with respect to 100 parts by weight of the sum of the electrically conductive powder and the glass frit. The resistor composition provides highly reproducible thick film resistors having superior properties and high stability over a wide range of resistance by addition of the tantalum double oxides.

4 Claims, No Drawings

RESISTOR COMPOSITION

BACKGROUND OF THE INVENTION

1. Field of the Invention

The present invention relates to tin oxide-based thick film resistor compositions which can be fired in an inert atmosphere, such as, nitrogen atmosphere, and which provide thick film resistors especially superior in reproducibility of resistivity and temperature characteristics.

2. Description of the Prior Art

Thick film resistors have been produced from a paste composition in the form of a paint or a paste consisting of conductive powder of metal, metal oxide and the like, and a glass frit dispersed in an organic vehicle. The composition is printed in a desired pattern onto an insulating substrate and fired. If necessary, trimming is conducted in order to obtain a desired resistivity. In the production of such thick film resistors, heretofore, ruthenium oxide-based resistors have been mainly employed, but, in recent years, tin oxide-based resistor compositions have been practically employed as thick film resistor materials which are firable in an inert atmosphere and provide resistors compatible with thick film conductors of base metals.

For instance, U.S. Pat. No. 4 322 477 (Japanese Patent Publication No. 59-15 161) discloses vitreous enamel resistors of tin oxide and glass frit. In order to regulate the resistance values, a certain heat treatment is conducted on tin oxide in a nitrogen atmosphere or a forming gas so as to cause controlled reduction of the tin oxide, prior to mixing it with the glass frit. U.S. Pat. No. 4 065 743 (Japanese Patent Publication No. 59-31 201) discloses resistor materials comprising a mixture of tin oxide and tantalum oxide or the products resulting from heat treatment of tin oxide and tantalum oxide admixed with a glass frit and states that the resistor materials have high resistivities with low temperature coefficient of resistance (hereinafter referred to as "TCR").

Further, there have been known resistor compositions comprising a mixture of two kinds of conductive powders, i.e., tin oxide and products resulting from heat treatment of and tantalum oxide, admixed with a glass frit. In these resistor compositions, since the resistivity can be adjusted by varying the mixing ratio of the two kinds of conductive powders without greatly varying the mixing ratio of the total amount of the conductive component to the amount of the glass frit, the TCR can be maintained at low levels over a wide range of resistivities and resistors having superior environmental characteristics, such as moisture resistance, high temperature characteristics and the like, can be produced.

However, since conventional tin oxide type resistors are disadvantageous in that since variation of resistance (i.e., dispersion of resistance) is large and TCR is instable, serious problems have arisen with regard to stability and reproducibility of resistor properties. Especially, since the resistors consisting of tin oxide and a glass frit exhibit highly negative TCR values, low TCR values close to 0 ppm/° C. have been desired for the resistors.

Further, the tin oxide-glass system resistor materials also have difficulties in providing low resistance values, for example, in the vicinity of 1 kilo-ohm/square and, generally, low resistance values less than 10 kilo-ohms/square can not be obtained. In even the tin oxide-glass resistors including tantalum oxide, the resistance is controllable only in a high resistance range. When other oxide additives are added for resistance control, the addition is limited to small amounts and the properties of the resistors may widely vary. Therefore, variation of the resistance and TCR will be unfavorably large.

SUMMARY OF THE INVENTION

It is therefore an object of the present invention to provide highly stable and reproducible resistors having a low TCR and desired quality in which problems associated with variation of resistance and TCR values are improved.

It is another object of the present invention to provide tin oxide-based resistors having superior properties over a wide range of resistivity and, especially, low resistivities of about 10 kilo-ohms/square or less which have not been achieved in the prior art.

According to the present invention, there is provided a resistor composition comprising at least one electrically conductive powder selected from the group consisting of (a) tin oxide powder and (b) powder resulting from heat treatment of tin oxide and tantalum oxide, a glass frit and a double oxide of tantalum dispersed in an organic vehicle. In the resistor composition, the mixing amount of the double oxide of tantalum is preferably 30 parts by weight or less with respect to 100 parts by weight of the sum of the electrically conductive powder and the glass frit.

A double oxide is a kind of compound oxide and contains two or more kinds of metals having similar ionic radiuses. The double oxide of tantalum of the present invention may be also metal tantalates. As the double oxide of tantalum used in the present invention, there may be mentioned, for example, alkali metal tantalates such as $NaTaO_3$, $KTaO_3$ or the like; alkaline earth metal-tantalum double oxides, such as $BaTa_2O_6$, $CaTa_2O_6$, etc.; transition metal-tantalum double oxides, such as $CoTa_2O_6$, $NiTa_2O_6$, $FeTa_2O_6$, $FeTaO_4$, $CuTa_2O_6$, $AgTaO_3$, $ZnTa_2O_6$, $TiTa_2O_4$, $VTaO_4$, $CrTaO_4$, $MnTa_2O_6$, $YTaO_4$, lanthanide metal-tantalum double oxides, etc.; and $GaTaO_4$, $InTaO_4$, $SnTa_2O_7$, $SbTaO_4$ or the like.

In the present invention, at least one electrically conductive powder selected from the group consisting of (a) tin oxide powder and (b) powder produced from heat treatment of tin oxide and tantalum oxide is employed as the conductive component. The resistivity of the resulting resistor can be adjusted to the desired level by varying the mixing ratio of the powder (a) and the powder (b), without widely varying the ratio of the conductive component to the glass frit. The tin oxide powder (a) is preferably heat treated in an inert atmosphere or reducing atmosphere in accordance with a conventional manner in order to control the oxygen content thereof. The heat treatment of tin oxide and tantalum oxide to produce the powder (b) is performed, for example, by mixing tin oxide powder and tantalum oxide powder and heating the powder mixture at temperatures of about 500 to 1300° C. in an inert atmosphere or reducing atmosphere.

There is no specific limitation for the composition of the glass frit and any known non-reducible glass which has been used in known tin oxide-based resistors may be employed. As the glass frit, there may be exemplified alkaline earth borosilicate glass, alkaline earth-aluminum borosilicate glass, etc.

Also, the conductive powder and the glass frit may be in advance heat-treated and employed as a compound powder.

The organic vehicles are used in this invention are any conventional organic vehicles employed in the art as long as they are volatilized or burnt out by firing. Examples of the organic vehicles for the purpose of the invention are organic solvents such as terpineol, butyl-carbitol, butyl-carbitolacetate, 2,2,4-trimethyl-1,3-pentanediol monoisobutyrate or the like; and mixtures of these organic solvents and resins such as ethyl cellulose, nitrocellulose, ethylhydroxyethylcellulose, acrylic resin, alkyd resin, etc., or plasticizer. In the present invention, the organic vehicle is used in order to provide the resistor compositions in paste or ink form and its amount is adjusted depending on the manner of application.

Further, appropriate additives which have been usually employed in tin oxide-based resistors may be also discretionally added to the resistor composition of the present invention.

The tantalum double oxide of the present invention provides improvements in dispersion of the properties such as resistance values, TCR, etc., even in only small amounts. Therefore, resistors having excellent stability of the properties can be readily formed. Further, the tantalum double oxide has an advantageous effect of reducing the absolute TCR value toward zero.

Further, when certain tantalum double oxides are added to resistor compositions of relatively low resistances, comprising tin oxide and glass, the addition provides not only low TCR values close to 0 ppm/° C. but also considerably reduced resistance values. As examples of tantalum double oxides having such advantageous effects, there may be mentioned $CoTa_2O_6$, $NiTa_2O_6$, $GaTaO_4$, $SnTa_2O_7$ and the like. Alternatively, some other tantalum double oxides exhibit the effect of increasing resistance values when they are added to resistor compositions of relatively high resistance utilizing the heat treated powder product of tin oxide and tantalum oxide as the conductive component. Therefore, the tantalum double oxides of the invention are effective not only as a TCR improving additive but also as an additive permitting the regulation of resistance values.

The invention will now be described in detail with reference to the following Examples.

The conductive powders employed in Examples of the present invention and Comparative Examples were prepared in the following procedure.

$SnO_2$ powder was placed in an alumina crucible and heated in a nitrogen atmosphere by heating at 800° C. for one hour and then at 1200° C. for one hour and slowly cooled. The resulting powder product is hereinafter referred to as "heat-treated $SnO_2$ powder".

Besides the heat-treated $SnO_2$ powder, $SnO_2$ powder and $Ta_2O_5$ were thoroughly mixed in a weight ratio of 70 : 30 ($SnO_2$ : $Ta_2O_5$) and milled in a ball mill. The powder mixture was placed in an alumina crucible and heat treated in a nitrogen atmosphere by heating at 800° C. for one hour and then heating at 1200° C. for one hour and slowly cooled. The resulting powder product is referred to as "heat-treated $SnO_2/Ta_2O_5$ powder".

EXAMPLE 1.

70 parts by weight of the heat-treated $SnO_2$ powder, 30 parts by weight of a glass frit of $SiO_2$-$B_2O_3$-BaO-$SnO_2$-CaO system and 2 parts by weight of cobalt tantalate ($CoTa_2O_6$) were thoroughly admixed together with an organic vehicle consisting of 24 parts by weight of 2,2,4-trimethyl-1,3-pentanediol monoisobutyrate and 1 part by weight of ethyl cellulose to form a resistor composition in a paste form.

The thus obtained resistor paste was printed in a square pat of 1mm×1mm onto an alumina substrate having copper film thick electrodes fired thereon, dried at 150° C. for a period of ten minutes in air, then fired in a nitrogen atmosphere by a 60 minute firing cycle with firing at a peak temperature of 900° C. for 10 minutes. The resulting resistor was examined for the resistance values, TCR (H-TCR on the hot side ranging from +25° C. to +125 ° C. and C-TCR on the cold side ranging from +25° C. to −55° C.) and the coefficient of variation of resistance (CV) and the results are shown in Table 1.

EXAMPLES 2 to 6

Resistor pastes were formulated in the same manner as described in Example 1 except that tantalum double oxides shown in Table 1 were used in place of $CoTa_2O_6$. Each resistor paste was fired onto an alumina substrate and the properties of the resulting resistor are shown in Table 1.

COMPARATIVE EXAMPLE 1

A comparative resistor paste was formulated in the same manner as described in Example 1 except that $CoTa_2O_6$ was not added. The properties of the resistor fired on an alumina substrate are shown in Table 1. The TCR was highly negative and variation of the resistance values was large as shown in Table 1.

COMPARATIVE EXAMPLE 2

A comparative resistor paste was prepared in the same manner as set forth in Example 1 except that $Ta_2O_5$ was used in place of $CoTa_2O_6$. The properties of the resulting resistor fired onto an alumina substrate are shown in Table 1.

TABLE 1

| | Examples of the Invention | | | |
|---|---|---|---|---|
| Composition | 1 | 2 | 3 | 4 |
| (parts by weight) | | | | |
| Heat-treated $SnO_2$ powder | 70 | 70 | 70 | 70 |
| Glass frit | 30 | 30 | 30 | 30 |
| Additive | $CoTa_2O_6$ | $NiTa_2O_6$ | $SnTa_2O_7$ | $BaTa_2O_6$ |
| Amount of additive | 2 | 2 | 2 | 2 |
| Resistance (ohms/sq.) | 11.27k | 8.48k | 10.56k | 11.55k |
| H-TCR (ppm/°C.) | −38 | −110 | −194 | −87 |
| C-TCR (ppm/°C.) | −81 | −186 | −330 | −146 |
| CV (%) | 4.0 | 6.8 | 6.1 | 5.4 |

| | Examples of the Invention | | Comparative Examples | |
|---|---|---|---|---|
| Composition | 5 | 6 | 1 | 2 |
| (parts by weight) | | | | |
| Heat-treated $SnO_2$ powder | 70 | 70 | 70 | 70 |
| Glass frit | 30 | 30 | 30 | 30 |
| Additive | $NaTaO_3$ | $GaTaO_4$ | — | $Ta_2O_5$ |
| Amount of additive | 2 | 2 | — | 2 |
| Resistance (ohms/sq.) | 13.68k | 9.30k | 14.81k | 62.30k |
| H-TCR (ppm/°C.) | −76 | −219 | −1009 | −622 |
| C-TCR (opm/°C.) | −128 | −367 | −1622 | −938 |

TABLE 1-continued

| | | | | |
|---|---|---|---|---|
| CV (%) | 4.3 | 4.3 | 8.2 | 8.5 |

As is clear from the results shown in Table 1, addition of the tantalum double oxide of the present invention provides great improvements in variation of resistance values and TCR. In Example 1 to 4 and 6, it has been found that the tantalum double oxide has also an effect of reducing resistance values. The results of Comparative Example 2 show that variation of resistance is not improved by addition of $Ta_2O_5$.

EXAMPLE 7

56 parts by weight of heat-treated $SnO_2$ powder, 14 parts by weight of heat-treated $SnO_2/Ta_2O_5$ powder, 30 parts by weight of a glass frit of $SiO_2$-$B_2O_3$-BaO-$SnO_2$-CaO and 6 parts by weight of $CoTa_2O_6$ powder were homogeneously mixed in an organic vehicle consisting of 24 parts by weight of 2,2,4-trimethyl-1,3-pentanediol monoisobutyrate and 1 part by weight of ethyl cellulose to form a resistor paste.

The resistor paste was fired onto an alumina substrate in the same manner as described in Example 1 and a resistor was obtained. The properties of the resistor are shown in Table 2.

EXAMPLE 8

A resistor paste was prepared in the same manner as set forth in Example 7 except that $NiTa_2O_6$ was employed in place of $CoTa_2O_6$. The resistor obtained by firing the resistor paste onto an alumina substrate had properties as shown in Table 2.

COMPARATIVE EXAMPLES 3 and 4

Comparative resistor pastes were prepared in the same manner as described in Example 7 except that $CoTa_2O_6$ was omitted and the mixing ratio of the conductive powders was changed as given in Table 2. The properties of the thus obtained resistors fired onto an alumina substrate are shown in Table 2.

TABLE 2

| | Examples of the Invention | | Comparative Examples | |
|---|---|---|---|---|
| | 7 | 8 | 3 | 4 |
| Composition (parts by weight) | | | | |
| Heat-treated $SnO_2$ powder | 56 | 56 | 14 | 56 |

TABLE 2-continued

| | Examples of the Invention | | Comparative Examples | |
|---|---|---|---|---|
| | 7 | 8 | 3 | 4 |
| Heat-treated $SnO_2/Ta_2O_5$ powder | 14 | 14 | 56 | 14 |
| Glass frit | 30 | 30 | 30 | 30 |
| Additive | $CoTa_2O_6$ | $NiTa_2O_6$ | — | — |
| Amount of additive | 6 | 5 | — | — |
| Resistance (ohms/sq.) | 297.8k | 433.6k | 357.7k | 84.0k |
| H-TCR (ppm/°C.) | +7 | −38 | −271 | −203 |
| C-TCR (ppm/°C.) | +51 | +15 | −238 | −170 |
| CV (%) | 3.6 | 4.8 | 8.8 | 7.5 |

As will be noted from Table 2, the resistors obtained in accordance with the present invention also have excellent properties with respect to variation of the resistance values and TCR properties in a high resistance range. In comparing Examples 7 and 8 with Comparative Example 4, the additive oxides of the present invention exhibit not only the effect of increasing resistance values but also the effect of shifting the TCR toward the positive side in tin oxide-tantalum oxide resistors.

As described above, by adding tantalum double oxides to tin oxide-based resistor compositions, thick film resistors having superior properties and high stability can be obtained with ease and a high reproducibility over a wide range of resistances ranging from a medium resistance to a high resistance.

What is claimed is:

1. An electrical resistor composition comprising at least one electrically conductive powder selected from the group consisting of (a) tin oxide powder and (b) powder resulting from heat treatment of tin oxide and tantalum oxide, a glass frit and a double oxide of tantalum and at least one metal selected from the group consisting of alkali metals, alkaline earth metals, gallium, indium, tin, antimony and transition metals other than tantalum.

2. An electrical resistor composition as claimed in claim 1 in which the mixing amount of said double oxide of tantalum is 30 parts by weight or less with respect to 100 parts by weight of the sum of said electrically conductive powder and said glass frit.

3. An electrical resistor composition as claimed in claim 1, in which said transition metals are lanthanide metals.

4. An electrical resistor composition as claimed in claim 1, in which said at least one metal is selected form the group consisting of sodium, gallium, cobalt, nickel, tin and barium.

* * * * *